United States Patent [19]

Fukuda et al.

[11] Patent Number: 4,987,830

[45] Date of Patent: Jan. 29, 1991

[54] PAPER FEED DEVICE FOR ROTARY PRESS

[75] Inventors: Akira Fukuda, Osaka; Itsuro Masuda, Higashiosaka, both of Japan

[73] Assignee: Hamada Printing Co., Ltd., Osaka, Japan

[21] Appl. No.: 432,872

[22] Filed: Nov. 7, 1989

[51] Int. Cl.[5] ..... B41F 13/02

[52] U.S. Cl. ..... 101/228; 101/231; 226/92; 400/613.1

[58] Field of Search ..... 101/228, 231; 226/91, 226/92; 400/613.1, 250

[56] References Cited

U.S. PATENT DOCUMENTS 3,761,001 9/1973 Bolza-Schunemann et al. ... 101/228
4,188,108 1/1980 Falomo ..... 226/92

FOREIGN PATENT DOCUMENTS 2241127 3/1974 Fed. Rep. of Germany .

*Primary Examiner*—David A. Wiecking
*Assistant Examiner*—Ren Yan
*Attorney, Agent, or Firm*—Wenderoth, Lind & Ponack

[57] ABSTRACT

A paper feed device for use with a rotary press for printing newspapers includes a plurality of guide rails connected together so as to extend along any of different paper feed paths. A linear member is inserted into the guide rail so as to be fed through guide rails extending along a predetermined paper feed path. A lever has its one end secured to one side of the linear member and is provided at its other end with a clip for detachably engaging a paper coupling adaptor holding the leading end of a web of a paper roll stored in a paper feed unit of the rotary press. The linear member is moved along the guide rails by pairs of driving and driven wheels arranged at equal intervals along the guide rails. The linear member has a length slightly larger than the distance between the adjacent pairs of wheels.

4 Claims, 4 Drawing Sheets

PAPER FEED DEVICE FOR ROTARY PRESS

BACKGROUND OF THE INVENTION

The present invention relates to a paper feed device for use with a rotary press for printing newspapers.

With a conventional rotary press, a flat belt formed with a slit is passed through the machine in a loop along a path most frequently used (such as the monochromatic printing course). A roll of printing paper provided in a paper feed unit of the press is unrolled so that its leading end is inserted into the slit in the flat belt. The flat belt is driven by a guide roller in the press or by a separate small motor. By moving the flat belt, the printing paper can be fed to a predetermined position in the press.

It is necessary to change the paper feed path in accordance with a change in the printing mode, e.g. from monochromatic printing to multicolor printing, or a change in the number of pages of the papers to be printed. But with this type of prior art press, more than one paper feed path can not be provided beforehand between each paper feed unit and each printing unit. Thus such a change in the paper feed path must be done manually and requires a large amount of time and labor.

SUMMARY OF THE INVENTION

It is an object of the present invention to provide a paper feed device for use with a rotary press which has a plurality of paper feed paths between a single paper feed unit and a single printing unit and which permits an easy change of paths from one to another.

In accordance with the present invention, there is provided a paper feed device for use with a rotary press for printing newspapers, comprising a plurality of guide rails connected together so as to extend along different paper feed paths, a linear member adapted to move along the guide rails, a lever having one end thereof secured to one side of the linear member and provided at the other end thereof with means for detachably engaging a paper coupling adaptor coupled to the leading end of a roll of paper stored on a paper feed unit of the rotary press, and driving means arranged along the guide rails at predetermined intervals to feed the linear member along the guide rails, the linear member having a length slightly larger than the distance between the adjacent driving means.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENTS

Figure 5:
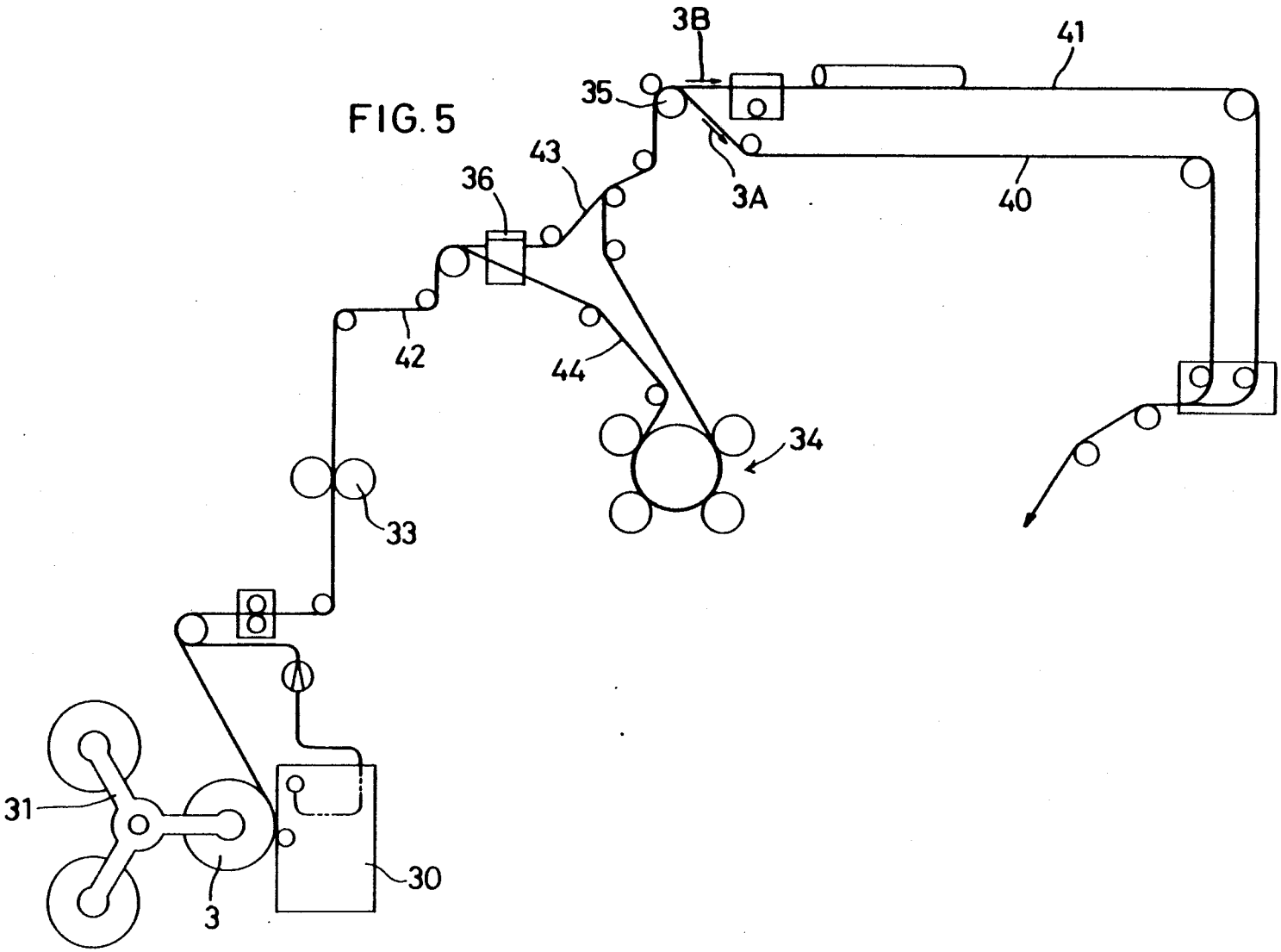
FIG. 5 is a schematic view of the rotary press equipped with the paper feed device according to the present invention.

FIG. 5 shows a rotary press provided with the paper feed device according to the present invention. It includes a paper feed unit 30 provided with a trifurcated arm 31 having a roll of printing paper 3 supported on one of the branches of the arm. The printing paper 3 is unrolled and, fed along one of a plurality of paper feed paths. Along the paper feed paths, there are provided a B—B (blanket-to-blanket) press 33 for double-side printing, a satellite press 34 for color printing and a slitter 35, which are arranged in this order. Between the B—B press 33 and the satellite press 34, there is provided a switch 36 for selectively feeding the printing paper toward the satellite press 34 or the slitter 35.

The web of paper drawn out of the roll 3 is fed through the B—B press 33 to the switch. When merely applying monochromatic printing on both sides of the paper, the paper is printed by the B-B press 33 and is fed through the switch 36 directly to the slitter 35. For color printing, the paper is fed through the switch 36 to the satellite press 34 and then to the slitter 35.

If the paper has a width four times larger than the width of one page of newspaper, it is slitted in half by the slitter 35 into two webs 3A and 3B. One of the webs 3A is fed on a straight coarse 40 while the other 3B is fed on a turnbar path 41 provided with turnbars which serve to move the web being fed on the path turnbar path 41 widthwise so as to be put over the web fed on the straight path 40.

If the printing paper fed to the slitter 35 has a width twice the width of one page of newspaper, it will be fed onto the straight course 40 as it is, without being slitted by the slitter 35.

The slitted webs of paper 3A and 3B being fed along the straight path 40 and the turnbar path 41, respectively, are put one upon the other and are fed into a former 38.

In the following description, the paper feed path extending from the paper feed unit 30 to the course switch 36 will be referred to as a common path 42, the path extending from the switch 36 directly to the slitter 35 as a monochromatic printing path 43, and the path extending from the switch 36 to the slitter 35 through the satellite press 34 as a color printing path 44.

Now referring to FIGS. 1 to 4, numerals 6A, 6B and 6C designate guide rails extending along the common path 42, the monochromatic printing path 43 and the color printing path 44, respectively. The guide rails 6A to 6C are pipes having a sufficient rigidity (such as conduit pipes) and formed with a longitudinal slit S extending along one side thereof so as to have a sectional shape of the letter C. A flexible linear member 16 is inserted into the guide rails so as to be fed therethrough. The guide rails 6A to 6C are formed in the top and bottom thereof with a plurality of pairs of cutouts **9*a* and 9*b*** at equal longitudinal intervals (3 meters for example), each pair of cutouts being opposed to each other.

Figure 6:
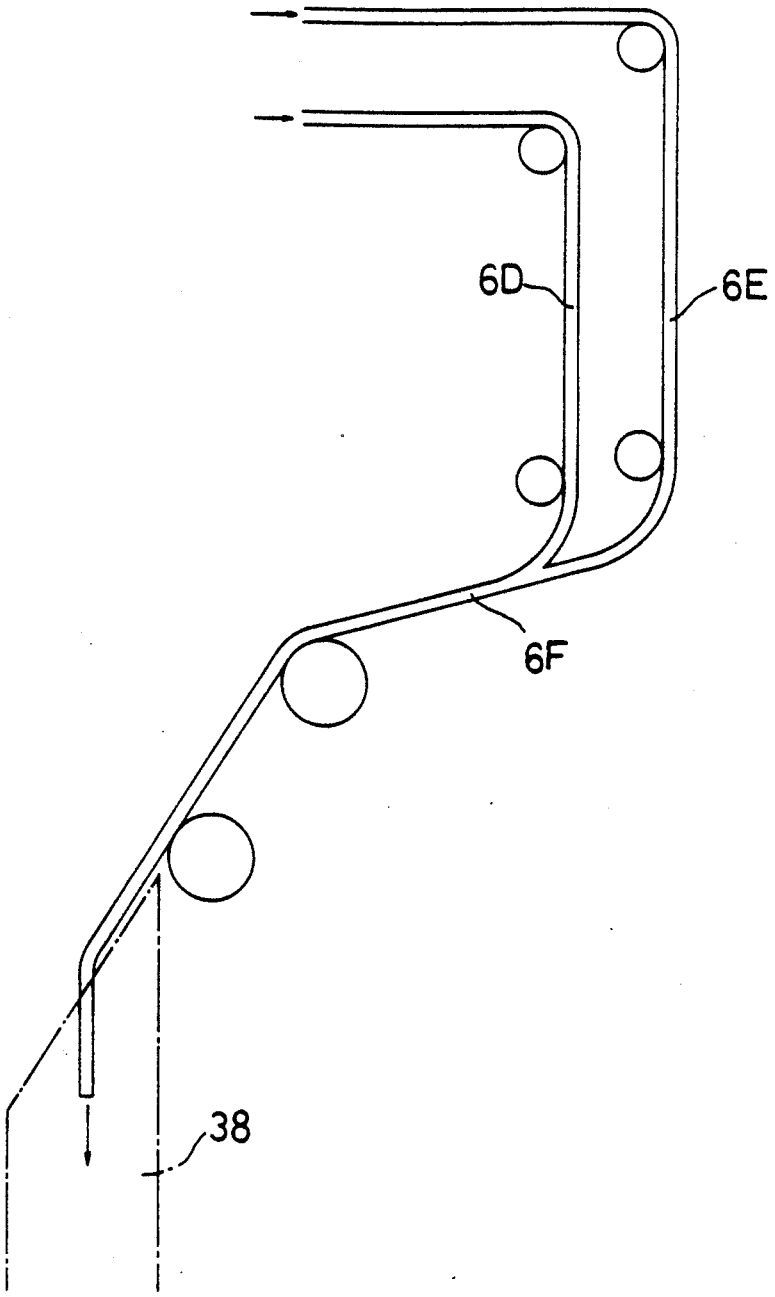
FIG. 6 is a schematic view of a portion of the paper feed device, showing how a plurality of guide rails converge into a single rail.

Guide rails 6D and 6E having the same structure as the rails 6A to 6C are provided along the straight path 40 and the turnbar path 41 shown in FIG. 5. As shown in FIG. 6, the guide rails extending along the straight path 40 and the turnbar path 41 converge at their terminal ends into a single guide rail 6F extending to the former 38. This guide rail 6F has the same structure as the other guide rails 6A to 6E, too.

Figure 3:
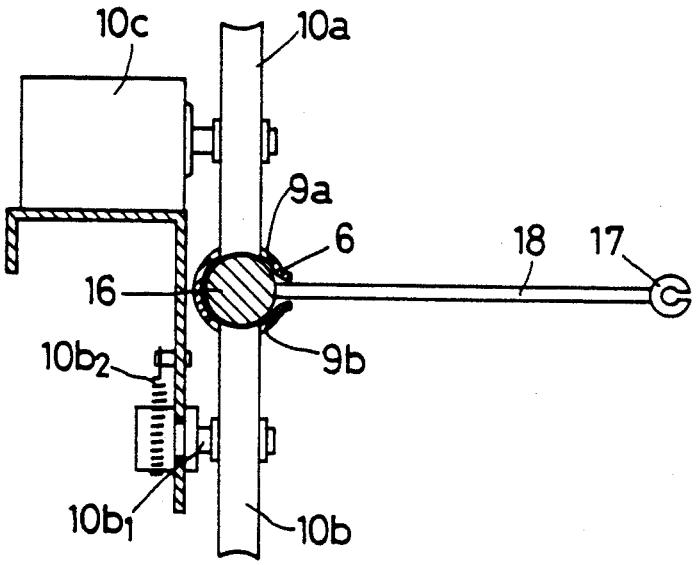
FIG. 3 is a sectional view of the guide rail, linear member and driving means thereof.
Figure 4:
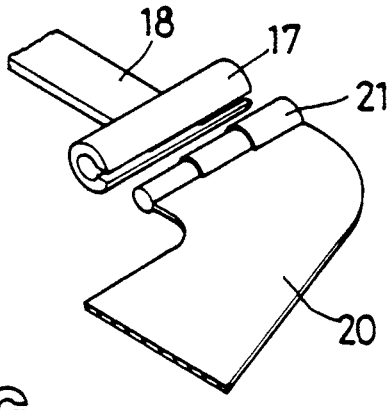
FIG. 4 is a perspective view of the clip and the paper coupling adaptor.

As best shown in FIG. 3, driving wheels 10a and driven wheels 10b protrude into the guide rails 6 through the cutouts 9a and 9b, respectively. Each driving wheel 10a is adapted to be turned in either direction by a respective motor 10c. Each driven wheel 10b is normally biased upwardly by a spring 10b2 secured to its shaft 10b1.

Figure 1:
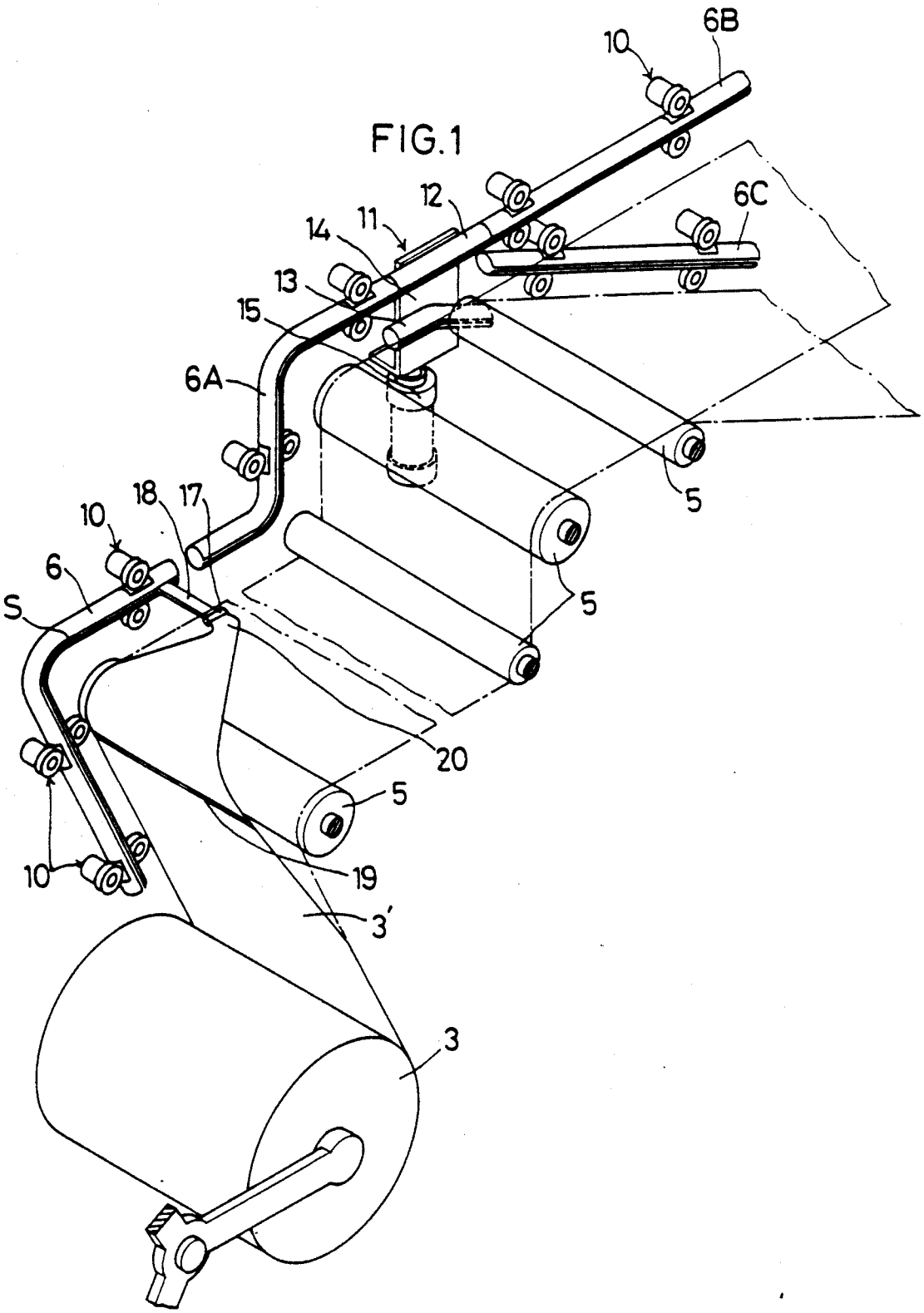
FIG. 1 is a perspective view of a portion of the paper feed device embodying the present invention.

As shown in FIG. 1, the course switch 11 provided between the guide rails 6A and 6B comprises a slide member 14 having switching guide rails 12 and 13 secured thereto and a cylinder 15 for moving the slide member 14 up and down to connect the guide rail 6A selectively to the guide rail 6B extending along the monochromatic printing path 43 through the guide rail 12 or to the guide rail 6C extending along the color printing path 44 through the guide rail 13.

Figure 2:
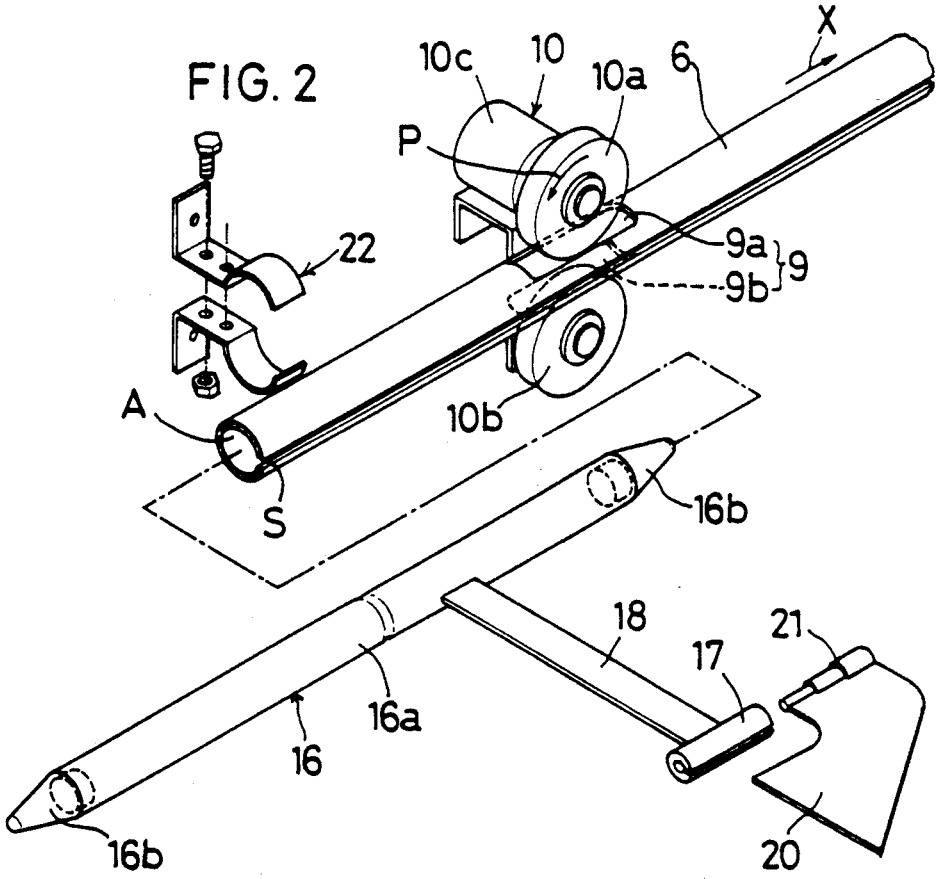
FIG. 2 is a perspective view of a portion of the guide rail and the linear member of the same.

The linear member 16 is spindle-shaped as shown in FIG. 2 and is adapted to be fed through the winding guide rails 6. It is made of a synthetic resin or leather with caps 16b made of a rather hard material disposed on both ends thereof and has a length slightly larger than the distance between adjacent pairs of cutouts 9.

A lever 18 provided on one end thereof with a clip 17 is secured at the other end to one side of the linear member 16. As shown in FIGS. 1 and 2, the clip 17 is adapted to detachably engage a coupling end 21 of a paper coupling adaptor 20 (FIG. 4) made of synthetic resin and having the leading end 3' of the printing paper 3 secured thereto by means of an adhesive member 19 such as a double-sided tape.

The guide rails 6 are fixed in position by rail fixing members 22 arranged at equal intervals as shown in FIG. 2.

In operation, if no color printing is necessary, the cylinder 15 in the switch 11 is moved to such a position that the rail 6A is connected to the rail 6B through the switching rail 12.

To connect the printing paper 3 to the linear member 16 in the guide rail 6A, its end 3' is cut obliquely and secured to the paper coupling adaptor 20 by means of the adhesive member 19. Then the coupling end 21 of the adaptor 20 is fitted in the clip 17 connected to the linear member 16 through the lever 18.

The driving wheels 10a are turned in the direction of arrow P in FIG. 2, with the linear member 16 in the guide rail 6, so that the linear member 16 will begin to move in the direction X toward the printing unit. The linear member 16, which is longer than the distance between adjacent pairs of cutouts 9a and 9b, will be always held between adjacent pairs of driving wheels 10a and driven wheels 10b and thus can be moved in either direction at any desired speed by controlling the driving wheels 10a. The linear member 16 will proceed, unrolling the web of paper 3 until the end 3' of the paper 3 reaches the former 38, where a limit switch (not shown) is activated to stop the linear member 16.

In this state, the coupling portion 21 is detached from the clip 17 connected to the linear member 16, while the end 3' of the paper 3 is removed from the paper coupling adaptor 20. The end 3' thus removed is inserted into the former 38.

By rotating the motors 10c in the reverse direction, the linear member 16 can be fed in the guide rails in the opposite direction toward the starting position.

When applying color printing to the paper, the cylinder 15 is moved to such a position that the rail 6A is connected to the rail 6C through the switching rail 13.

What is claimed is:

1. A paper feed device of a rotary press, said device comprising a plurality of guide rails connected together so as to extend along different paper feed paths, a linear member adapted to move along said guide rails, a lever having one end thereof secured to one side of said linear member and provided at the other end thereof with means for detachably engaging a paper coupling adaptor capable of being coupled to the leading end of a roll of paper, and driving means for driving said linear member along said guide rails, said driving means comprising a plurality of pairs of rollers rotatably supported in the device at fixed predetermined intervals along said guide rails, and a motor operatively connected to one roller of each of said pairs of rollers to drive said one roller, said linear member having a length slightly larger than the interval between adjacent pairs of said rollers such that said pairs of rollers successively engage said linear member to feed said linear member along said guide rails.

2. A paper feed device as claimed in claim 1, wherein each of said guide rails are tubular and have a slit extending therealong, said linear member is flexible and is disposed within said guide rails which said lever extending through said slit, said guide rails define a plurality of pairs of opposed recesses therein which pairs of said recesses are spaced from one another at said predetermined intervals, and said pairs of rollers respectively protrude into said pairs of opposed recesses to successively engage and feed said linear member along said guide rails.

3. A paper feed device as claimed in claim 1, wherein said guide rails extend along a printing path, a straight path and a turnbar path, and further comprising switch means interposed between said printing path and each of said straight and said turnbar paths for selectively guiding said linear member from the guide rail along which said printing path terminates to the guide rail along which one of said straight and said turnbar paths begins, said switch means including a slide member, a pair of switching guide rails mounted to said slide member and spaced apart from one another, and cylinder means connected to said slide member for moving said slide member between a first position at which one of said switching guide rails extends between said printing and said straight paths and a second position at which the other of said switching guide rails extends between said printing and said turnbar paths.

4. A paper feed device as claimed in claim 3, wherein each of said guide rails are tubular and have a slit extending therealong, said linear member is flexible and is disposed within said guide rails with said lever extending through said slit, said guide rails define a plurality of pairs of opposed recesses therein which pairs of said recesses are spaced from one another at said predetermined intervals, and said pairs of rollers respectively protrude into said pairs of opposed recesses to successively engage and feed said linear member along said guide rails.

* * * * *